US005136917A

United States Patent [19]

Kunimoto

[11] Patent Number: 5,136,917

[45] Date of Patent: Aug. 11, 1992

[54] MUSICAL TONE SYNTHESIZING APPARATUS UTILIZING AN ALL PASS FILTER FOR PHASE MODIFICATION IN A FEEDBACK LOOP

[75] Inventor: Toshifumi Kunimoto, Hamamatsu, Japan

[73] Assignee: Yamaha Corporation, Hamamatsu, Japan

[21] Appl. No.: 523,711

[22] Filed: May 15, 1990

[30] Foreign Application Priority Data

May 15, 1989 [JP] Japan ..... 1-121229

[51] Int. Cl.[5] ..... G10N 1/12

[52] U.S. Cl. ..... 84/624; 84/661; 84/699; 84/DIG. 9; 84/DIG. 10

[58] Field of Search ..... 84/661, 699, 700, DIG. 9, 84/659, 660, DIG. 10, 26, 622-624; 364/724.17; 381/17

[56] References Cited

U.S. PATENT DOCUMENTS

| | | | |
|---|---|---|---|
| 3,939,437 | 2/1976 | Adam | 84/DIG. 26 |
| 3,974,461 | 8/1976 | Luce | 84/DIG. 9 |
| 4,130,043 | 12/1978 | Niimi | 84/DIG. 10 |
| 4,151,368 | 4/1979 | Fricke et al. | 84/DIG. 10 |
| 4,157,511 | 6/1979 | Laupman | 330/107 |
| 4,338,581 | 7/1982 | Morgan | 84/DIG. 26 |
| 4,352,954 | 10/1982 | Franssen et al. | 84/DIG. 26 |
| 4,399,326 | 8/1983 | Bode | 84/DIG. 9 |
| 4,475,229 | 10/1984 | Frese | 84/DIG. 26 |
| 4,554,858 | 11/1985 | Wachi et al. | 84/DIG. 9 |
| 4,655,115 | 4/1987 | Nishimoto | 84/DIG. 10 |
| 4,731,835 | 3/1988 | Fotamase et al. | 84/DIG. 26 |
| 4,815,354 | 3/1989 | Kunimoto | 84/DIG. 9 |
| 4,873,722 | 10/1989 | Tominari | 381/17 |
| 4,984,276 | 1/1991 | Smith | 381/63 |
| 5,036,541 | 7/1991 | Kato | 381/62 |
| 5,046,097 | 9/1991 | Lowe et al. | 381/17 |

FOREIGN PATENT DOCUMENTS

| | | |
|---|---|---|
| 63-40199 | 2/1988 | Japan . |
| 1-15075 | 3/1989 | Japan . |

OTHER PUBLICATIONS

Musical Applications of Microprocessors, Hayden Book Company Inc., Chamberlin, 1980, pp. 447-451.

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus has a closed-loop configuration including an adder, a filter and a delay circuit. The adder adds its feedback signal to a signal to be synthesized which is applied from an external device. The filter constructed as the all-pass filter has a frequency characteristic by which a phase delay between its input and output signals is varied in response to a frequency variation of its input signal. Such all-pass filter includes a delay element having a delay time which is set longer than a predetermined unit delay time corresponding to a sampling period to be employed. Herein, the output of adder is fed back to the adder via the all-pass filter and delay circuit as the feedback signal. Thus, a signal circulating the closed-loop is picked up as a synthesized musical tone signal.

5 Claims, 2 Drawing Sheets

MUSICAL TONE SYNTHESIZING APPARATUS UTILIZING AN ALL PASS FILTER FOR PHASE MODIFICATION IN A FEEDBACK LOOP

BACKGROUND OF THE INVENTION

1. Field of the Invention

The present invention relates to a musical tone synthesizing apparatus which is suitable to synthesize musical tones including anharmonic overtones whose frequencies are not true harmonics of the fundamental frequency.

2. Prior Art

The conventional musical tone synthesizing apparatus, as shown in FIG. 1, has a closed-loop configuration including an adder 1, a delay circuit 2 and a filter 3, all of which are designed as digital circuits. Herein, the delay circuit 2 is constructed by shift registers each further constructed by flip-flops of which number corresponds to the bit number of digital signal supplied from the adder 1. In addition, the clock is supplied to each flip-flop in the shift register by the predetermined sampling period ts. Therefore, delay circuit 2 has delay time tp equal to "Nts" which is obtained by multiplying the sampling period ts by stage number N of shift registers. The filter 3 is designed to apply the predetermined decay characteristic to the signal which propagates through the closed-loop shown in FIG. 1. Herein, transmission-frequency characteristic is adjusted in such a manner that the closed-loop gain becomes slightly smaller than "1".

Herein, the analog signal containing a great number of different frequency components such as the impulse signal is subject to the Pulse-Code Modulation (PCM) by every sampling period ts so that the analog signal is converted into the time-series digital signal, which is to be applied to the above-mentioned conventional musical tone synthesizing apparatus. Such digital signal is applied to the adder 1 and then circulating through the closed-loop consisting of the adder 1, delay circuit 2 and filter 3.

If the phase delay of the filter 3 can be neglected, circulating time of the digital signal which circulates the closed-loop once can be represented by the delay time tp of the delay circuit 2. In this case, the gain-frequency characteristic of this closed-loop has the maximal values at frequencies integral times the fundamental frequency $f_1=1/tp$. Since the closed-loop gain is slightly smaller than "1", the signal circulating the closed-loop is gradually attenuated. Then, by effecting the digital-to-analog (D/A) conversion on the output signal of adder 1, it is possible to obtain the musical tone signal containing the fundamental wave and other higher harmonic waves which are produced at frequencies integral times the fundamental frequency $f_1$. Herein, the amplitude of the musical tone signal is gradually attenuated in lapse of time.

However, the above-mentioned conventional apparatus is disadvantageous in that the delay time tp required for circulating the digital signal through the closed-loop once cannot be set at arbitrary delay time other than delay times integral times the sampling period ts. In order to obtain the delay time shifted from such delay times integral times the sampling period ts, an all-pass filter (APF) 4 is inserted between the delay circuit 2 and filter 3 as shown in FIG. 2. This APF 4 is designed as the primary-stage all-pass filter which is constructed by adders 41, 42, multipliers 43, 44 and a delay circuit 45.

In FIG. 2, the delay circuit 2 is constructed by the flip-flops of which number corresponds to the bit number of the digital signal to be transmitting through the delay circuit 2. As similar to the foregoing delay circuit 2 shown in FIG. 1, the clock is supplied to each of the flip-flops in the delay circuit 2 shown in FIG. 2 by every predetermined sampling period ts.

In the APF 4, the adder 41 adds the output of delay circuit 2 to the output of multiplier 44. The output of adder 41 is supplied to the adder 42 via the delay circuit 45, while the delayed signal outputted from the delay circuit 45 is multiplied by multiplication coefficient "−a" and then fed back to the adder 41. In addition, the output of adder 41 is multiplied by multiplication coefficient "a" in the multiplier 43 and then fed to the adder 42. Herein, desirable values in a range between "−1" and "+1" are used as the coefficients "a", "−a". The adder 42 adds the outputs of the delay circuit 45 and multiplier 43 together, and then the addition result thereof is supplied to the filter 3.

Hereinafter., description will be given with respect to the characteristic cf APF 4. In this case, transmission function H(z) of the APF 4 can be represented by the following formula (1).

$$H(z)=(a+z^{-1})/(1+az^{-1}) \tag{1}$$

As known well, frequency characteristic $F(\omega)$ can be represented by the following formula (2) by replacing "$z^{-1}$" by $\exp(-j\omega ts)$ in formula (1), wherein "$\omega$" designates the angular frequency (i.e., $\omega=2\pi f$, f designates frequency).

$$F(\omega)=[a+exp(-j\omega ts)]/[1+a\ exp(-j\omega ts)] \tag{2}$$

Next, gain-frequency characteristic $G(\omega)$ can be represented by the following formula (3).

$$\begin{aligned} G(\omega) &= |F(\omega)| \\ &= |a+\exp(-j\omega ts)|/|1+a\exp(-j\omega ts)| \\ &= 1 \end{aligned} \tag{3}$$

As indicated in the above formula (3), it can be said that the gain of APF 4 is at the constant value "1" at all frequencies.

Next, phase delay $P(\omega)$ of the APF 4 can be represented by the following formula (4), wherein $\arg[F(\omega)]$ represents the phase angle of complex function $F(\omega)$.

$$\begin{aligned} P(\omega) &= -arg[F(\omega)] \\ &= \tan^{-1} - a\sin(\omega ts)/[1+a\cos(\omega ts)] \\ &- \tan^{-1} - \sin(\omega ts)/[a+\cos(\omega ts)] \end{aligned} \tag{4}$$

By use of approximate calculation $\tan^{-1}(X)\approx X$ which is used when X is small enough, the above formula (4) can be approximately rewritten to the following formula (5).

$$P(\omega)\approx\sin(\omega ts)/[a+\cos(\omega ts)]-a\sin(\omega ts)/[1+a\cos(\omega ts)] \tag{5}$$

In the case where the angular frequency "$\omega$" is very small as comparing to Nyquist angular frequency $\omega n=2\pi fs/2$ and the phase angle $\omega ts$ is close to zero, approximations such as $\sin(\omega ts)\approx\omega ts$ and $\cos(\omega ts)\approx 1$ can be applied to the above formula (5). Then, the following formula (6) can be obtained.

$$P(\omega) \approx (1-a)/1+a)\omega ts \quad (6)$$

Thus, equivalent delay time ta of the APF 4 can be represented by the following formula (7).

$$ta = P(\omega)/\omega \approx (1-a)/(1+a)ts \quad (7)$$

In short, it is possible to adjust the delay time of APF 4 by adjusting the coefficient a. Incidentally, the above-mentioned characteristic of the all-pass filter is described in the paper entitled "Extension of the Karplus—Strong Plucked—String algorithm" written in pages 56 to 69 of the Computer Music Journal, vol. 7, No. 2, 1983 in detail.

Thereafter, it is possible to obtain the resonance characteristic corresponding to the total delay time t=tp+ta in the closed-loop. Next, description will be given with respect to the resonance characteristic of the closed-loop shown in FIG. 2 by referring to graphs shown in FIGS. 3A to 3C.

FIG. 3A shows the relation between the frequency f and phase delay $\theta$ in the delay circuit 2. As shown in FIG. 3A, when frequency f of the signal passing through the delay circuit 2 is at $f_1=1/tp$, the phase difference $\theta$ is at $2\pi$. Similarly, the phase difference $\theta$ is at $4\pi$ when f is at $f_2$ which is two times larger than $f_1$; and $\theta$ is at $6\pi$ when f is at $f_3$ which is three times larger than $f_1$. In short, the phase delay $\theta$ increases linearly as the frequency f increases (see line A in FIG. 3A). In addition, when the frequency f is at frequencies integral times the fundamental frequency $f_1$, both of the input and output signals of the delay circuit 2 are at the same phase.

FIG. 3B shows the relation between the phase delay $\theta$ and frequency f in the APF 4. As indicated in the foregoing formula (6), while the frequency f belongs to the range whose frequency is very small as comparing to the Nyquist frequency 1/(2ts), the phase delay $\theta$ varies linearly in proportional to the frequency f. However, if the frequency f is varied in the relatively wide frequency range in the vicinity of Nyquist frequency 1/(2ts), the phase delay $\theta$ must be varied nonlinearly in accordance with curve B shown in FIG. 3B.

The musical tone synthesizing apparatus as shown in FIG. 2 operates in response to the total phase delay of closed-loop which is obtained by adding the phase delays due to the delay circuit 2 and APF 4 (see FIGS. 3A, 3B). The solid line C in FIG. 3C indicates the total phase delay of closed loop. Therefore, the phase delay $\theta$ of the digital signal which circulates the closed-loop is turned to be at $2\pi$, $4\pi$, $6\pi$ at frequencies $f_{1a}$, $f_{2a}$, $f_{3a}$ which are slightly shifted from frequencies $f_1$, $f_2$, $f_3$ respectively due to the APF 4 to be inserted between the delay circuit 2 and filter 3. When the frequency f is at $f_{1a}$, $f_{2a}$, $f_{3a}$ etc., the signal phase is not changed even if the signal circulates the closed-loop so that the closed-loop gain becomes maximal, which indicates the resonance state.

Since the non-linear relation is established between the frequency f and phase delay $\theta$, the frequencies $f_{1a}$, $f_{2a}$, $f_{3a}$ are not disposed at equal intervals. Due to the APF 4, it is possible to synthesize a musical tone containing "anharmonic overtones" whose frequencies are slightly shifted from frequencies integral times the fundamental frequency. In general, "overtones" are defined as harmonic tones whose frequencies are equal to frequencies integral times the fundamental frequency of the note being played. Herein, "anharmonic overtones" are defined as almost harmonic but nonharmonic tones whose frequencies are slightly shifted from frequencies integral times the fundamental frequency (see U.S. Pat. No. 3,888,153). By use of the filter in which the frequency varies non-linearly with respect to the phase delay, it is possible to synthesize the musical tone containing the anharmonic overtones, which is disclosed in U.S. Pat. No. 4,130,043.

However, the musical tone actually sounded from the nonelectronic musical instrument (i.e., acoustic instrument) has the anharmonic overtones whose frequencies are quite shifted from frequencies integral times the fundamental frequency. Particularly, in case of the percussion instrument, its percussion tone to be sounded contains the anharmonic overtones whose frequencies are quite different from frequencies integral times the fundamental frequency. However, the conventional musical tone synthesizing apparatuses described herein cannot produce the anharmonic overtones whose frequencies are quite shifted from frequencies integral times the fundamental frequency. Thus, there is a problem in that the conventional apparatus cannot synthesize the musical tone having the high-fidelity to the harmonic and anharmonic overtone structure of the sound of acoustic instrument such as the percussion instrument.

SUMMARY OF THE INVENTION

It is accordingly a primary object of the present invention to provide a musical tone synthesizing apparatus capable of synthesizing the musical tone having the anharmonic overtone structure of the sound of the acoustic instrument such as the percussion instrument.

In an aspect of the present invention, there is provided a musical tone synthesizing apparatus comprising:

operation means for carrying out a predetermined operation on its input signals including a signal to be synthesized which is applied from an external device;

all-pass filter means including a delay element having a delay time which is set longer than a predetermined unit delay time; and delay means which is connected with the operation means and the all-pass filter means together in a closed-loop, so that an output of the operation means is fed back to the operation means via the delay means and the all-pass filter means, whereby a signal circulating the closed-loop is picked up as a synthesized musical tone signal.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF THE PREFERRED EMBODIMENT

Next, description will be given with respect to an embodiment of the present invention.

Figure 1:
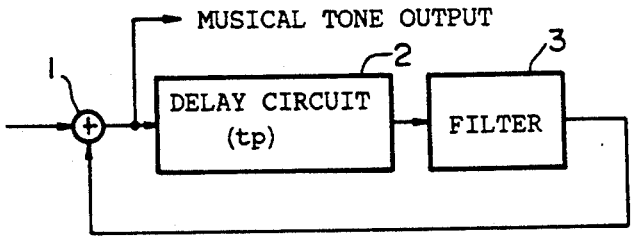
FIG.1 (PRIOR ART)
FIGS. 1 and 2 are block diagram showing the conventional musical tone synthesizing apparatuses.
Figure 2:
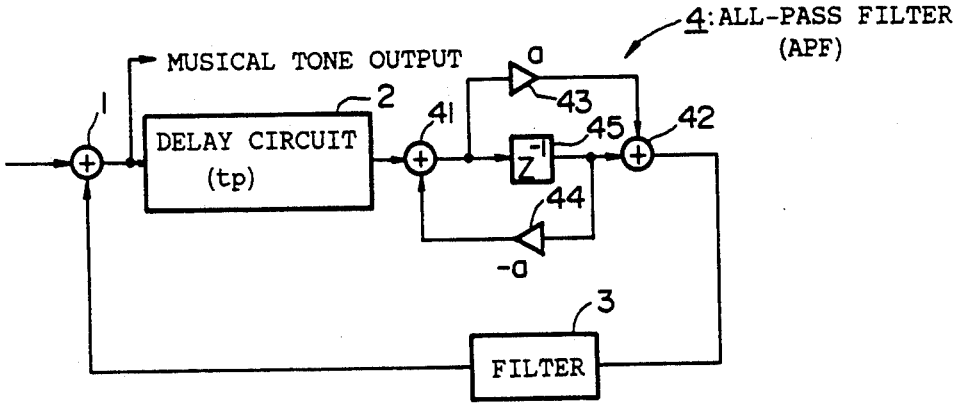
FIG.2 (PRIOR ART)
Figure 4:
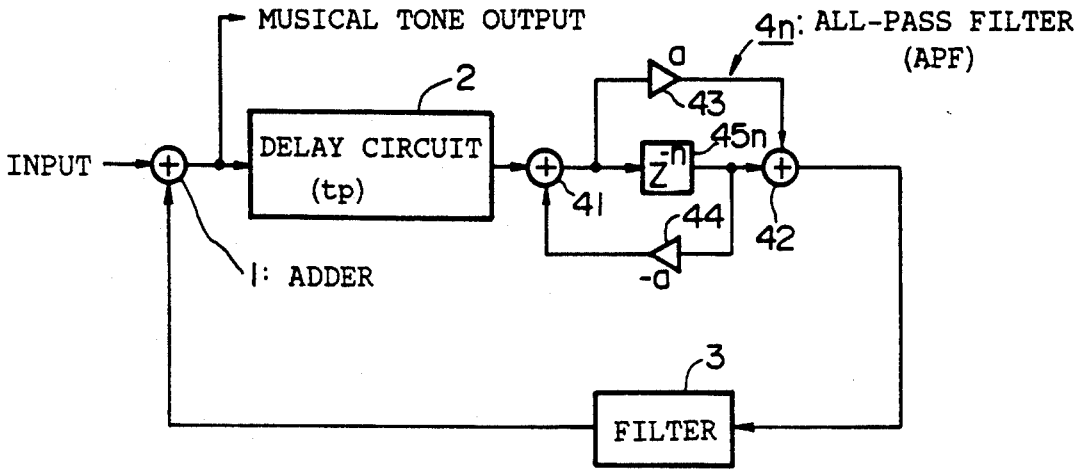
FIG. 4 is a block diagram showing an electric configuration of the musical tone synthesizing apparatus according to an embodiment of the present invention.

FIG. 4 is a block diagram showing the electric configuration of the musical tone synthesizing apparatus according to an embodiment of the present invention, wherein parts identical to those in FIG. 1 will be designated by the same numerals, hence, description thereof will be omitted. The musical tone synthesizing apparatus shown in FIG. 4 is characterized by using an all-pass filter (APF) 4*n* instead of the foregoing APF 4 shown in FIG. 2. This APF 4*n* is different from the foregoing APF 4 in that a delay circuit 45*n* is used instead of the delay circuit 45. This delay circuit 45*n* has the delay time tn=nts which is n times longer than the sampling period ts.

The phase delay Pn(ω) of this APF 4*n* can be represented by the following formula (8).

$$Pn(\omega)=\tan^{-1}]-a\sin(n\omega ts)]/[1+a\cos(n\omega ts)] -\tan^{-1}[-\sin(n\omega ts)]/[a+\cos(n\omega ts)] \quad (8)$$

Next, description will be given with respect to the resonance characteristic of the closed-loop as shown in FIG. 4 by referring to FIGS. 5A to 5C.

Figures 3A, 3B, 3C:
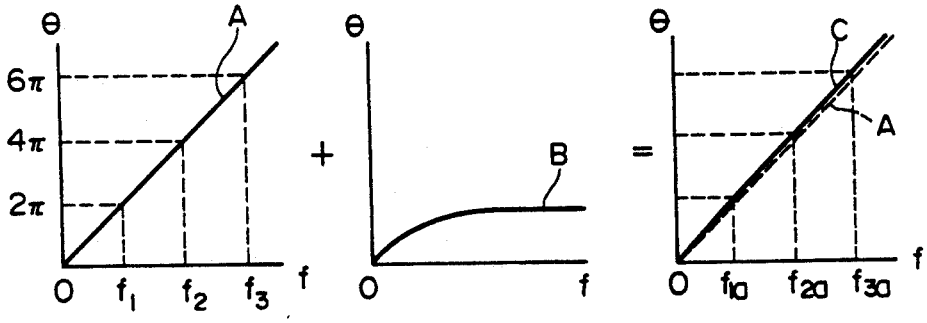
FIGS. 3A to 3C are graphs each showing the relation between the frequency and phase delay in the conventional musical tone synthesizing apparatus as shown in FIG. 2.
Figure 5A:
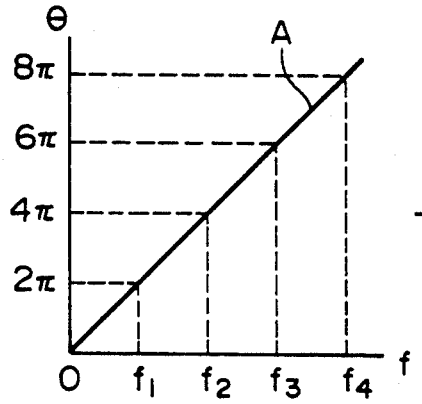
FIGS. 5A to 5C are graphs each showing the relation between the frequency and phase delay in the musical tone synthesizing apparatus as shown in FIG. 4.
Figure 5B:
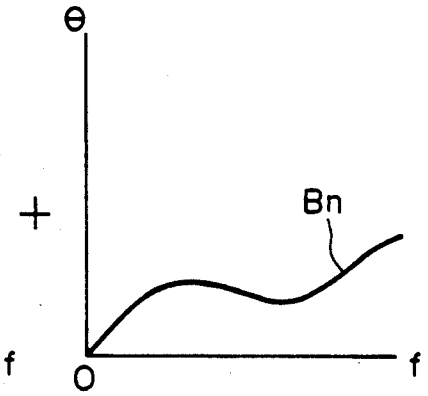

FIG. 5A (corresponding to FIG. 3A) shows the relation between the frequency f and phase delay $\theta$ in the delay circuit 2. FIG. 5B shows the relation between the frequency f and phase delay $\theta$ in the APF 4*n*. When the delay-stage number n of the APF 4*n* is relatively large, the phase angle nωts must be large even if the angular frequency $\omega=2\pi f$ is small in the formula (8). Therefore, in contrast to the foregoing APF 4, the linear approximation (see formula (7)) cannot be established in the APF 4*n*. In case of the APF 4*n*, the relation between the frequency f and phase delay $\theta$ must be indicated by curve Bn shown in FIG. 5B. As the frequency f is raised in FIG. 5B, the phase delay $\theta$ of the APF 4*n* is repeatedly increased and decreased. The increase of the stage number n introduces the increase of the increasing and decreasing times of the phase delay $\theta$ until the frequency f reaches the Nyquist frequency 1/(2ts).

Figure 5C:
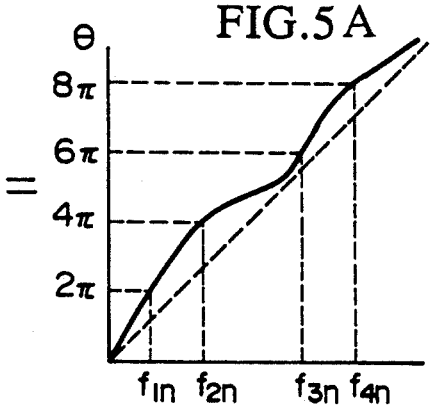

Thus, the total phase delay of the closed-loop shown in FIG. 4 will be indicated by FIG. 5C. In FIG. 5C, the phase delay $\theta$ varies with respect to the frequency variation in waving manner. Therefore, the resonance frequencies of the present closed-loop are at $f_{1n}$, $f_{2n}$, $f_{3n}$, . . . which are further deviated from $f_{1a}$, $f_{2a}$, $f_{3a}$, . . . shown in FIG. 3C. As described above, the present musical tone synthesizing apparatus can synthesize the musical tone signal including the anharmonic overtones whose frequencies are much deviated from frequencies integral times the fundamental frequency.

The present embodiment is constructed by the digital circuits, however, it is possible to embody the present invention by the analog circuits. By applying the APF 4*n* to the musical tone synthesizing apparatus which simulates the wind instrument, it is possible to synthesize the musical tone having the anharmonic overtone structure. Conventionally, Japanese Patent Laid-Open Publication No. 63-40199 discloses such musical tone synthesizing apparatus having the closed-loop including the non-linear function generating circuit which simulates the reed operation of the wind instrument and delay circuit whose delay time can be changed over in response to the pitch of the musical tone to be generated. Herein, by setting the closed-loop at the resonance state, the musical tone can be synthesized. In this case, by further inserting the APF 4*n* into such closed-loop, it is possible to synthesize the wind instrument tone having the anharmonic overtone structure. Incidentally, several kinds of design choices can be employed as the APF. For example, it is possible to modify the APF by use of some delay elements, multipliers, adders and the like. Even in such modified APF, it is possible to obtain the same effect of the present embodiment by setting the delay time of the APF larger than the unit delay time and then carrying out the same control of the present embodiment. In FIG. 4, the delay circuit 2 (having the delay time tp) is connected between the adder 1 and APF 4*n*. However, this delay circuit 2 can be connected between the APF 4*n* and filter 3. Or, it is possible to provide each of delay elements of the delay circuit with respect to each of stages of the filter in such a manner that the total delay time becomes equal to tp. Further, by providing the circuit having the non-linear transmission function in the closed-loop, it is possible to improve the variation of the tone color to be generated.

As described heretofore, this invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. A musical tone synthesizing apparatus comprising:
   operation means for carrying out a predetermined operation on its input signals including a signal which is applied from an external device and a feedback signal;
   all-pass filter means for changing phase characteristics of a signal applied thereto, said all-pass filter means including a delay element having a delay time which is set longer than a predetermined unit delay time; and
   delay means which is connected with said operation means and said all-pass filter means together in a closed-loop, so that an output of said operation means is fed back to said operation means via said delay means and said all-pass filter means as said feedback signal,
   whereby a signal circulating said closed-loop is picked up as a synthesized musical tone signal.

2. A musical tone synthesizing apparatus according to claim 1 wherein said all-pass filter means is constructed by plural stages of delay elements each delaying its input signai by said predetermined unit delay time.

3. A musical tone synthesizing apparatus according to claim 1 wherein said operation means includes an adder which adds said input signal to said feedback signal which is fed back thereto via said all-pass filter means and said delay means.

4. A musical tone synthesizing apparatus according to claim 1 wherein a signal circulating in said closed loop is digitally sampled at a predetermined sampling period and said predetermined delay time corresponds to the sampling period.

5. A musical tone synthesizing apparatus according to claim 1 wherein a tone pitch of the synthesized musical tone signal is determined based on a sum of the delay times of the delay means and the all-pass filter means.

* * * * *